US008240433B2

(12) United States Patent
Tseng

(10) Patent No.: US 8,240,433 B2
(45) Date of Patent: Aug. 14, 2012

(54) OIL DRAIN AND SUCTION PUMP

(75) Inventor: Tien-Tsai Tseng, Wufong Township, Taichung County (TW)

(73) Assignee: Chuan Jiing Enterprises Co., Ltd., Taichung County (TW)

( * ) Notice: Subject to any disclaimer, the term of this patent is extended or adjusted under 35 U.S.C. 154(b) by 349 days.

(21) Appl. No.: 11/905,400

(22) Filed: Sep. 28, 2007

(65) Prior Publication Data

US 2010/0254838 A1 Oct. 7, 2010

(51) Int. Cl.
*A61M 1/00* (2006.01)
*B65D 51/16* (2006.01)

(52) U.S. Cl. ..... 184/1.5

(58) Field of Classification Search ..... 184/1.5, 184/6.28, 24, 26, 27.3, 28, 32, 38.1, 39, 55.1, 184/58, 105.1; 417/85, 86, 118, 127, 199, 417/374, 437
See application file for complete search history.

(56) References Cited

U.S. PATENT DOCUMENTS 5,002,154 A * 3/1991 Chen ..... 184/1.5
5,450,924 A * 9/1995 Tseng ..... 184/1.5
6,357,492 B1 * 3/2002 Hsu ..... 141/26
6,463,952 B1 * 10/2002 Stevens ..... 137/205
6,508,280 B2 * 1/2003 Capstran ..... 141/98
6,558,138 B2 * 5/2003 Tseng ..... 417/374
6,722,389 B2 * 4/2004 Stevens ..... 137/588
6,722,855 B2 * 4/2004 Tien-Tsai ..... 417/199.1
7,367,366 B2 * 5/2008 Liao ..... 141/26
7,798,785 B2 * 9/2010 Tseng ..... 417/148
2003/0035741 A1 * 2/2003 Tseng ..... 417/374
2006/0124182 A1 * 6/2006 Kim ..... 137/625.65
2007/0048149 A1 * 3/2007 Chang ..... 417/374
2008/0078462 A1 * 4/2008 Minervini et al. ..... 137/625.64
2008/0219859 A1 * 9/2008 Tseng ..... 417/138

* cited by examiner

*Primary Examiner* — William E Dondero
*Assistant Examiner* — Mark K Buse
(74) *Attorney, Agent, or Firm* — Rosenberg, Klein & Lee

(57) ABSTRACT

A pump providing oil suction and oil drain functions includes a barrel and a lid; a first passage is disposed on a bottom of the barrel; the lid contains a second passage, a third passage, and a fourth passage; a regulating member is disposed on the lid to connect the third passage through the second passage and to allow air to flow in sequence from an oil storage space, the third passage, the second passage, a pipe, the first passage, a ventilation pipe, and the fourth passage into the ambient air for producing suction in oil suction operation; and to connect the fourth passage through the third passage for the ambient air to flow in sequence through the second passage, the pipe, the first passage, the ventilation pipe, the fourth passage, and the third passage to enter into the oil storage space for producing pressure during the oil drain operation.

7 Claims, 8 Drawing Sheets

OIL DRAIN AND SUCTION PUMP

BACKGROUND OF THE INVENTION (a) Field of the Invention

The present invention is related to an oil drain and suction pump, and more particularly, to a manually operated oil suction and drain pump.

(b) Description of the Prior Art

As illustrated in FIG. 9 of the accompanying drawings of the present invention for a sectional view of a pump of the prior art, the pump sucks in oil by manually operating a rod 41. When the rod 41 is reciprocally pulled up and down, air in an oil storage barrel 42 is sucked to pass through a longitudinally provided air guide passage 43, a lateral air guide passage 44, a space 45, and a central orifice 46 to flow into a piston tube 47, and then is expelled to the ambient air through a one-way release valve 48 disposed at a bottom of the piston tube 47; in turn, external oil is sucked through a pipette 49 to enter into the oil storage barrel 42 as the air in the oil storage barrel 42 is driven out.

However, the pump of the prior art though providing its basic function of oil suction fails to have the function of oil drain. Therefore, to pump out the oil in the barrel is very inconvenient since it takes to remove a lid from the barrel so to dump the oil from the oil storage barrel. Furthermore, if operation demands oil drain and oil suction functions, user has to purchase another pump that is provided with the function of oil drain. Other than the additional cost of purchasing another pump, alternative use of oil suction pump and oil drain pump cause the operation particularly inconvenient. Besides, storage of two pumps may be a problem if the space is very limited.

SUMMARY OF THE INVENTION

The primary purpose of the present invention is to provide a pump that is given dual functions of oil drain and oil suction in one unit to save costs incurred from buying and maintaining another pump and to make more space available for use.

To achieve the purpose, a pump of the present invention is essentially comprised of a barrel containing an oil storage space, and a first passage containing a leading in pore and a leading out pore disposed at a bottom of the barrel; a lid closing on a top of the barrel, a pipe is disposed in the oil storage space of the barrel with a lower end of the pipe disposed on the bottom of the barrel and connected through the inlet of the first passage and a top of the pipe connected to the lid, a pull rod is provided in the pipe and connected to an compression portion at one end in the pipe so to compress air flowing through the pipe, the rod penetrates through the lid to extend to expose out of the barrel, the lid is disposed with a second passage, the second passage contains a first air inlet and a first air outlet, the first air outlet connects through the pipe through an opening at the top of the pipe, the lid is provided with a third passage, the third passage contains a first through hole and a second through hole with the second through hole connecting through the oil storage space, a fourth passage containing a second air inlet and a second air outlet is further disposed on the lid with the second air inlet connecting through the leading out pore of the first passage by means of a ventilation pipe disposed in the oil storage space so that the air passes in sequence through the second passage, the pipe, the first passage, and the ventilation pipe to flow in the fourth passage; and a regulating member disposed on the lid to connect through the third passage and the second passage during oil suction and to connect the fourth passage through ambient air so to expel the air in the oil storage space through the second air outlet of the fourth passage for producing suction force to suck oil, or to connect through the fourth and the third passages and to connect through the ambient air and the first air inlet of the second passage for the air to enter through the second through hole of the third passage into the oil storage space for producing pressure to drain the oil.

DETAILED DESCRIPTION OF THE PREFERRED EMBODIMENTS

Figure 1:
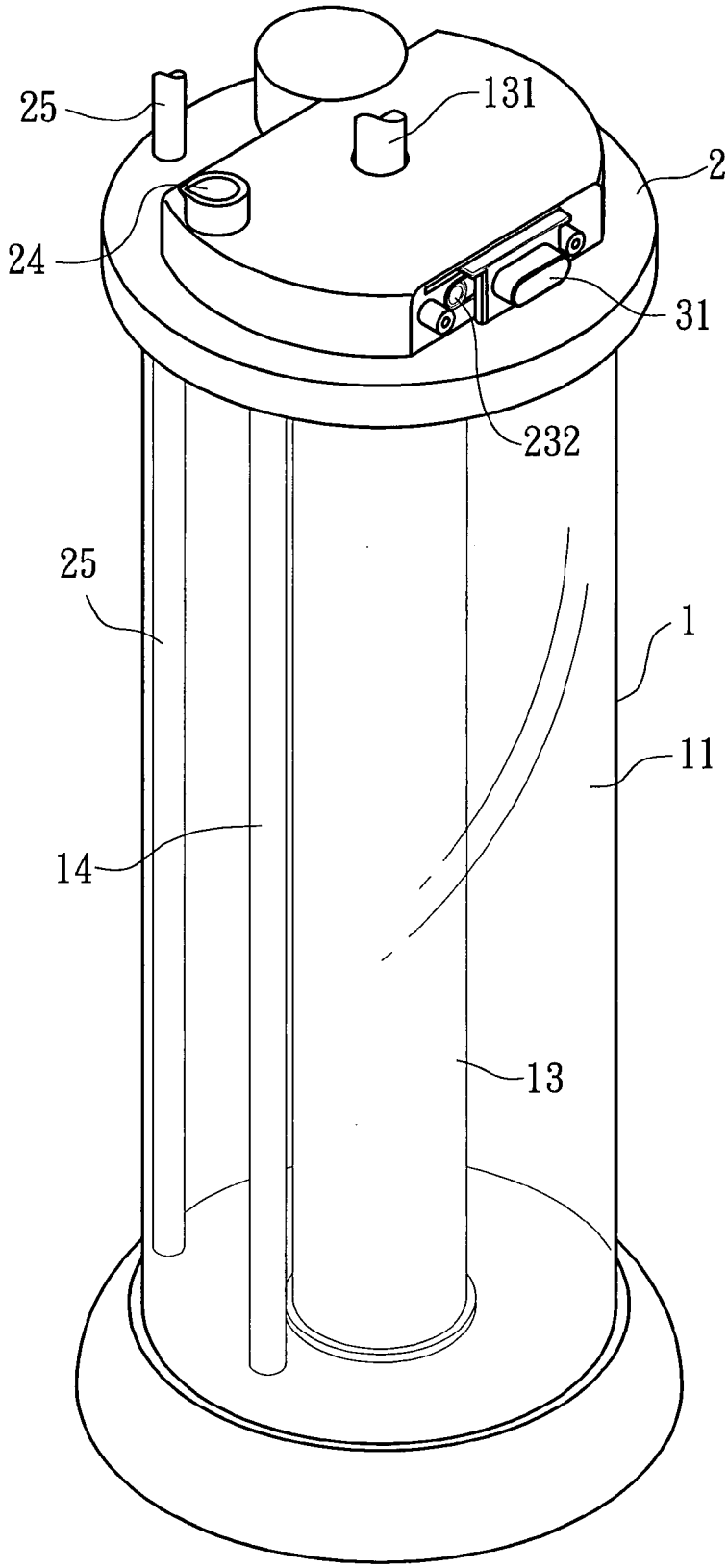
FIG. 1 is a perspective view of a first preferred embodiment of the present invention with a regulating member being located at where allowing oil suction operation.

Referring to FIGS. 1.about.3 for a first preferred embodiment of the present invention, a pump that provided with oil suction and oil drain functions is essentially comprised of a barrel 1, a lid 2, and a regulating member 31.

The barrel 1 contains an oil storage space 11; a first passage 12 is disposed on a bottom of the barrel 1; and the first passage 12 is provided with a leading in pore 121 and a leading out pore 122.

The lid 2 closing upon on a top of the barrel 1 contains a straight and hollow pipe 13 in the oil storage space 11 of the barrel 1; a lower end of the pipe 13 is disposed on the bottom of the barrel 1 and connected through the leading in pore 121 of the first passage 12; a top of the pipe 13 is connected to the lid 2; a pull rod 131 is disposed in the pipe 13; one end of the pull rod 131 in the pipe 13 is connected to a compression portion 132; the compression portion 132 limits air to flow only in one direction and to force air flowing through the pipe 13 to enter into the first passage 12 through the leading in pore 121; and the end of the pull rod 121 penetrating through the lid 2 and exposed in the ambient air is connected to a handle (not illustrated) to facilitate applying pull force manually.

The lid 2 is laterally provided with a second passage 21; both ends of the second passage are respectively disposed with a first air inlet 211 and a first air outlet 212; the first air outlet 212 is connected through interior of the pipe 13 through an opening at the top of the pipe 13.

A third passage 22 is laterally disposed to the lid 2; both ends of the third passage 22 are respectively disposed with a first through hole 221 and a second through hole 222; and the third passage 22 is connected through the oil storage space 11 through the second through hole 222.

The lid 2 is further laterally disposed with a fourth passage 23; both ends of the fourth passage 23 are respectively disposed with a second air inlet 231 and a second air outlet 232; the second air inlet 231 of the fourth passage 23 is connected through the leading out pore 122 of the first passage by means of a ventilation pipe 14 erected in the oil storage space 11 so to allow air to pass through in sequence the second passage 21, the pipe 13, the first passage 12, the ventilation pipe 14 to flow in the fourth passage 23; and the first air inlet 211, the first through hole 221, and the second air outlet 232 are arranged side by side.

In practice, the lid 2 is further provided with an oil orifice 24 to directly pour out the oil in the oil storage space 11; and an oil pipe 25 is penetrated through the lid 2 to allow oil circulation to facilitate oil drain and oil suction operation.

Figure 4:
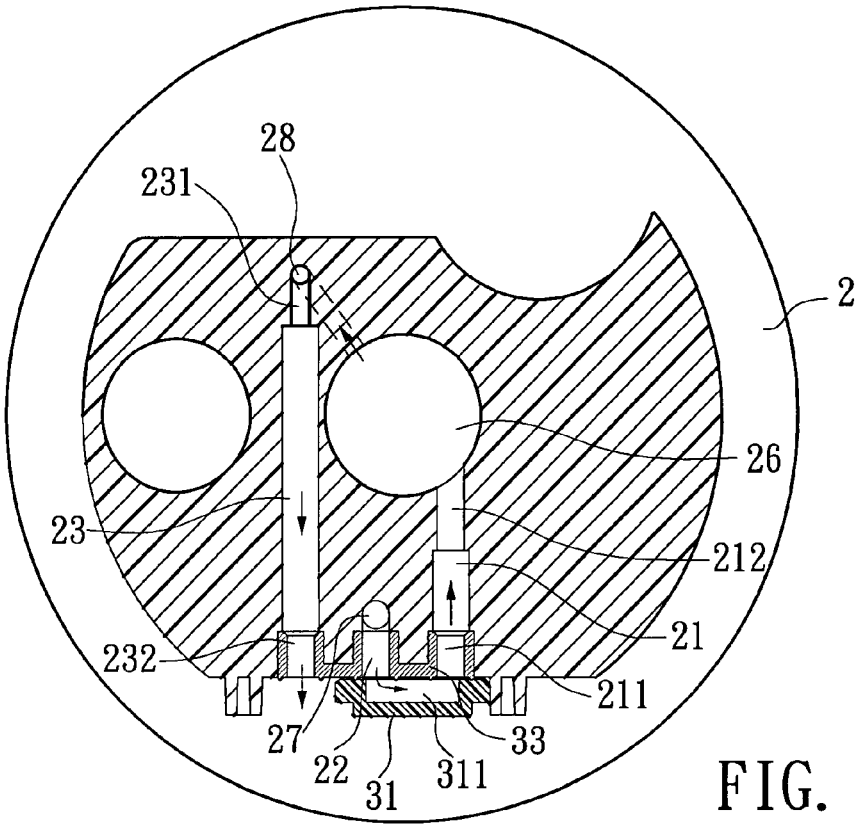
FIG. 4 is a layout showing observation of a bird's view on FIG. 1 with the regulating member being located at where allowing oil suction operation.
Figure 5:
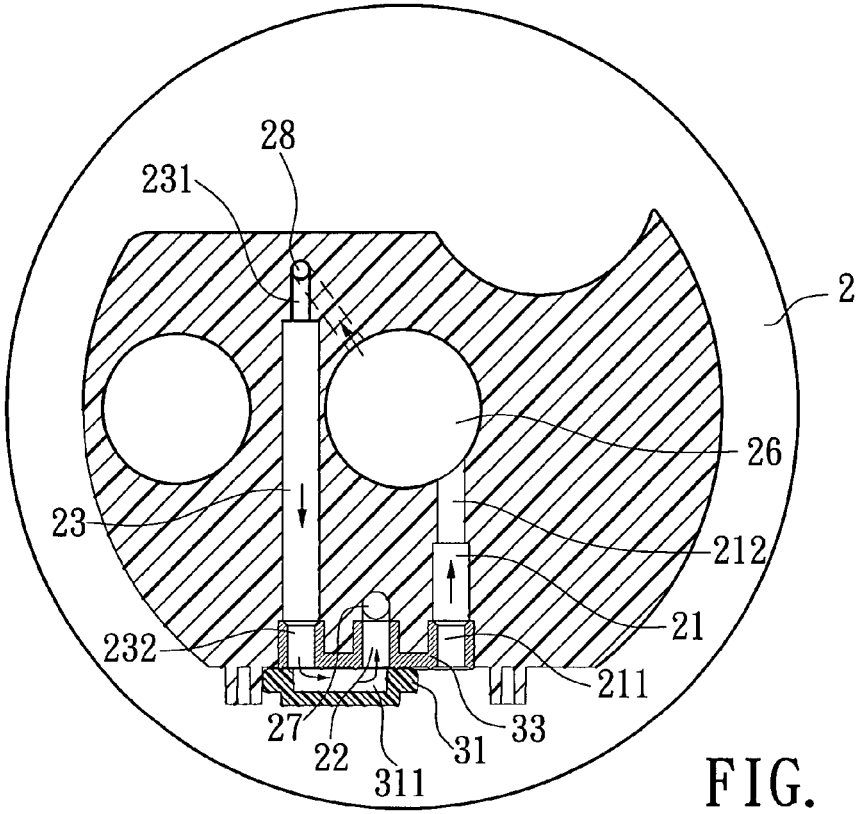
FIG. 5 is a layout observation of a bird's view on FIG. 4.
Figure 6:
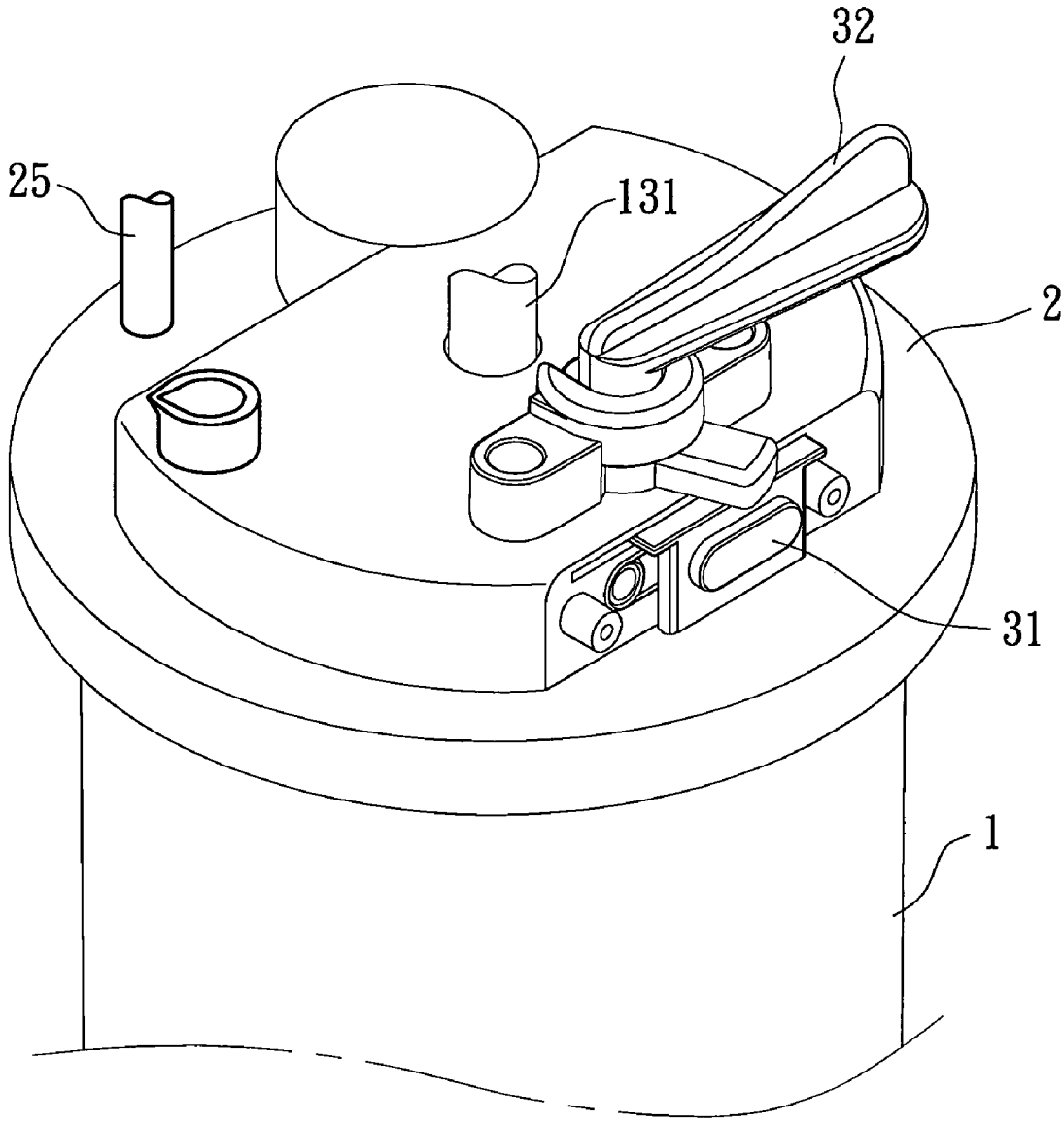
FIG. 6 is a perspective view showing that the regulating member is connected to a lever to facilitate operating the regulating member.

As shown in FIGS. 2-6, the second passage 21, third passage 22, and fourth passage 23 extend laterally inside the lid 2 between its top and bottom surfaces. As shown in FIG. 6, the lid 2 is formed with a side wall (not numbered) at which a regulating member 31 is disposed. The first air inlet 211 of the second passage 21, the first through hole 221 of the third passage 22, and the second air outlet 232 of the fourth passage 23 terminate at the side wall of the lid 2 to which the regulating member 31 is attached to permit an operational coupling therebetween as will be presented in the following description. The regulating member 31 is shaped with an air duct 311. The regulating member 31 is laterally displaceable along the side wall of the lid 2 to control the regime of the subject oil drain and suction pump. In oil suction regime of operation, shown in FIGS. 2 and 4, the regulating member 31 is laterally displaced to position the air duct 311 in air communication with the first through hole 221 of the third passage 22 and the first air inlet 211 of the second passage 22 to establish air communication therebetween, thus causing the first through hole 221 of the second passage 21, and the second air outlet 232 of the fourth passage 23 to connect through ambient air while operating the pull rod 131 to enable the compression portion 132 to compress the air in the oil storage space 11 to circulate in a route of air flow as described above to be finally expelled to the ambient air through the second air outlet 232 of the fourth passage 23 for producing the oil suction action. In the oil drain regime of operation, shown in FIGS. 3 and 5, the regulating member 31 is laterally displaced to position the air duct 311 in air communication with the first through hole 221 of the third passage 22 and the second air outlet 232 of the fourth passage 23 to establish air communication therebetween. In the oil drain regime of operation, the regulating member 31 is controlled to connect the second air outlet 232 of the fourth passage 23 through the first through hole 221 of the third passage 22 while connecting the ambient air through the first air inlet 211 of the second passage 21 for the ambient air to circulate by following the route described above and finally the ambient air flows into the oil storage space 11 through the second through hole 222 of the third passage 22 for producing pressure to drain the oil. The top of the regulating member 31 is connected to a lever 32 which is positioned on the top surface of the lid 2 to facilitate operating the regulating member 31 as illustrated in FIG. 6.

In the preferred embodiment, the regulating member is disposed to the top of the lid 2 to permit mobile regulation. In practice, the regulating member 31 is laterally regulated, and an air duct 311 is provided to the regulating member 31. In the operation of oil suction, the third passage 22 is connected through the second passage 21 through the air duct 311; or in the operation of oil drain, the fourth passage 23 is connected through the third passage 22 through the air duct 311. Secondly, the second passage 21, the third passage 22, and the fourth passage 23 are laterally disposed on the lid 2 with the third passage 22 located at where between the second passage 21 and the fourth passage 23. The first passage 12 is laterally disposed on the bottom of the barrel 1 and the first air outlet 212 of the second passage 21 is connected through the pipe 13 by means of a first perforation 26 disposed on the lid 2; the second through hole 222 of the third passage 22 is connected through the oil storage space 11 by means of a second perforation 27 disposed on the lid 2; and the fourth passage 23 is connected through the ventilation pipe 14 by means of a third perforation hole 28 dispose don the lid 2.

Furthermore, at the openings respectively of the first air inlet 211 of the second passage 21, the first through hole 221 of the third passage 22, and the second air outlet 232 of the fourth passage 23 are provided with a leak-proof structure 33 made of flexible material. The leak-proof structure 33 is assembled with the regulating member 31 so to prevent air current to escape from where between the leak-proof structure 33 and the regulating member 31 while the regulating member is executing alternative switch for regulation.

A one-way valve 141 to allow the air to pass only from the first passage 12 to the fourth passage 23 is disposed in the ventilation pipe 14 that connects the first passage 12 through the fourth passage 23.

Figure 2:
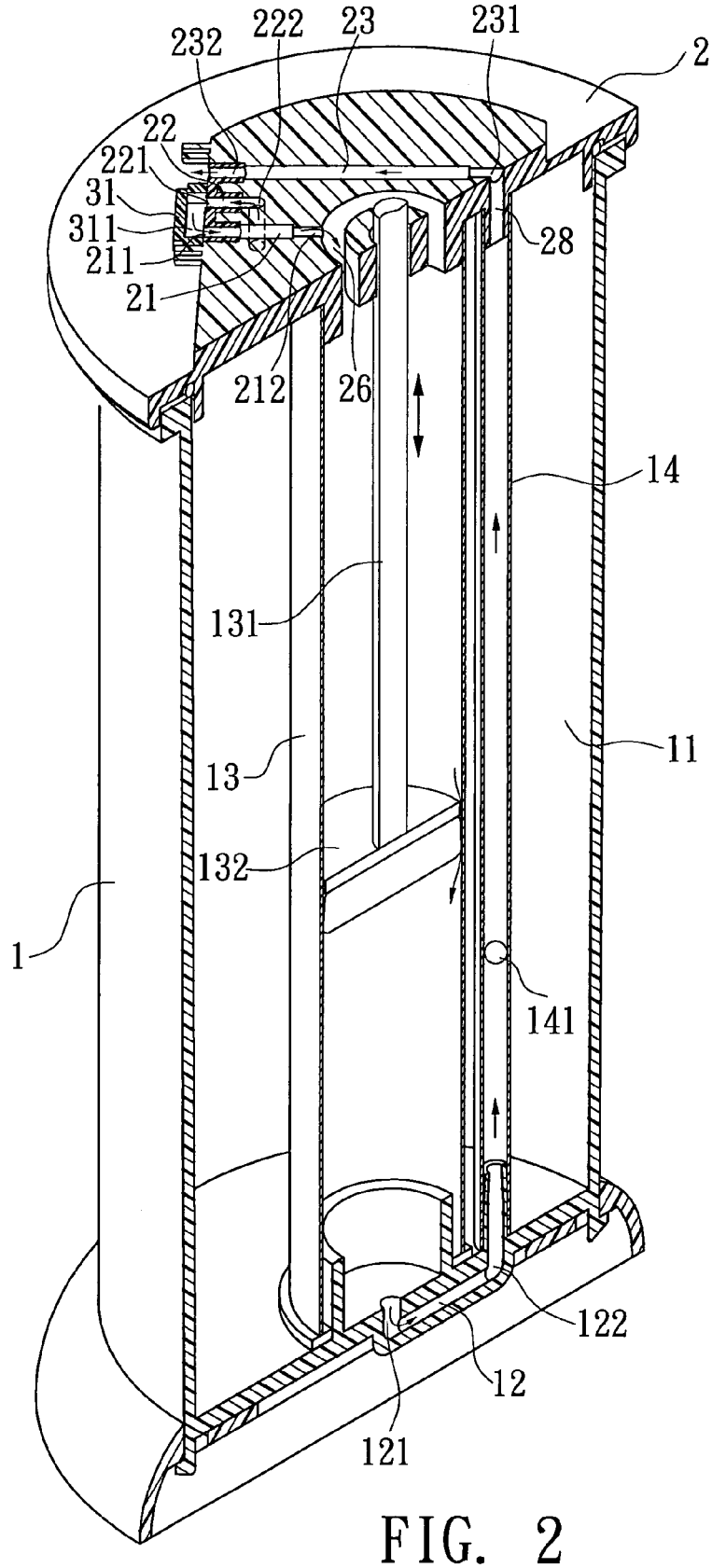
FIG. 2 is a sectional view taken from FIG. 1 for sectional observation in another direction with the regulating member being located at where allowing oil suction operation.
Figure 3:
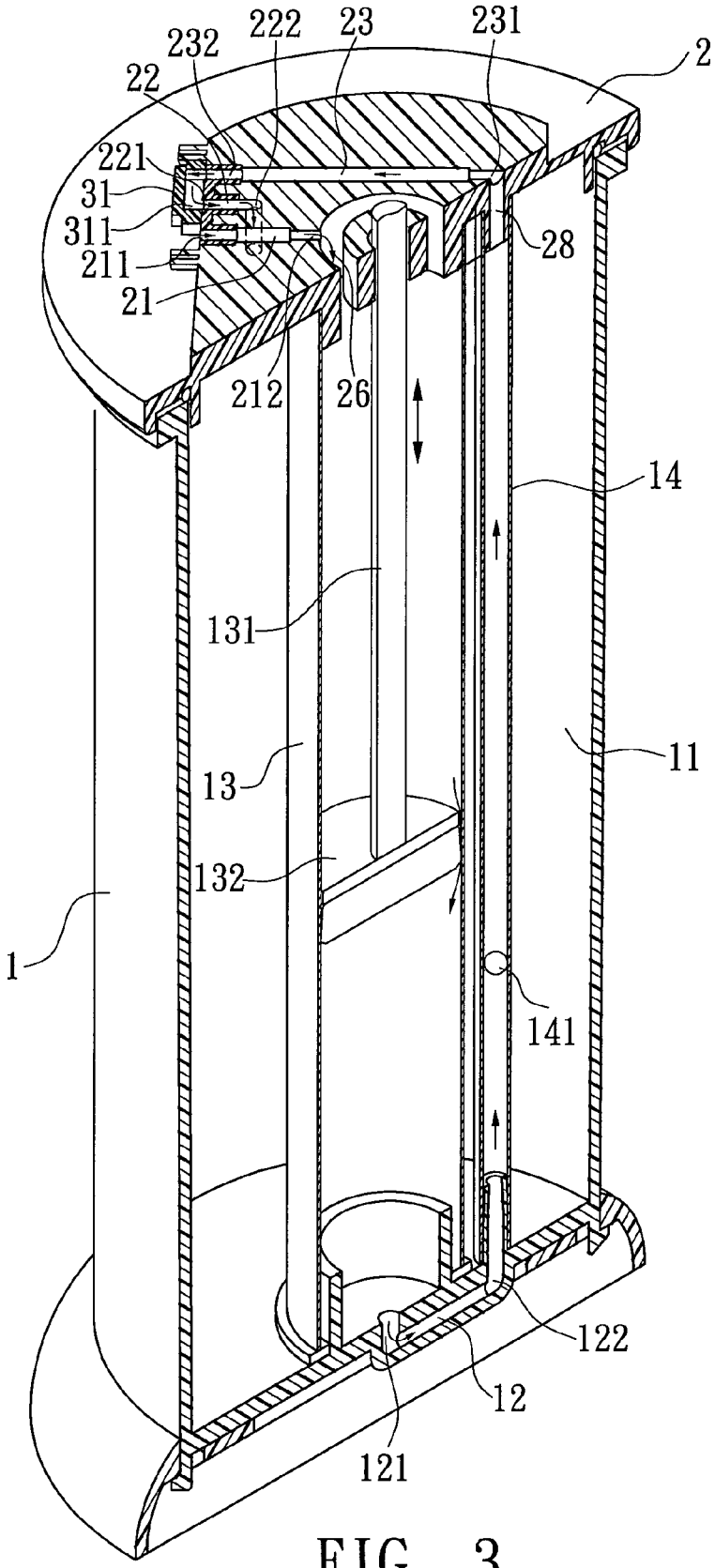
FIG. 3 is a sectional view taken from FIG. 1 for sectional observation in another direction with the regulating member being already regulated to a position where allowing oil drain operation.

As illustrated in FIGS. 1, 2, and 3 when an oil suction operation is desired, the regulating member 31 is dialed to allow the air duct 311 to connect through the third passage 22 and the second passage 21 while the pull rod 131 is reciprocally pulled up and down to produce a force to drive the air to flow. The air in the oil storage space 11 flows in sequence through the third passage 22, the air duct 311, the second passage 21, the pipe 13, the first passage 12, the ventilation pipe 14, and the fourth passage 23 to enter into the ambient air while creating a suction in the oil storage space 11 for the oil to flow into the oil storage space 11 of the barrel 1 through the oil pipe 25.

During the oil drain operation as illustrated in FIGS. 4 and 5, the regulating member 31 is dialed to permit the air duct 311 to connect through the fourth passage 23 and the third passage 22. The pull rod 131 is pulled reciprocally up and down to create a force to drive the air to flow so that the ambient air passes in sequence into the second passage 21, the pipe 13, the first passage 12, the ventilation pipe 14, the fourth passage 23, the air duct 311, and the third passage 22 to flow into the oil storage space 11, where an air pressure is created to compress the oil in the oil storage space 11 to drain into the ambient air through the oil pipe.

Figure 7:
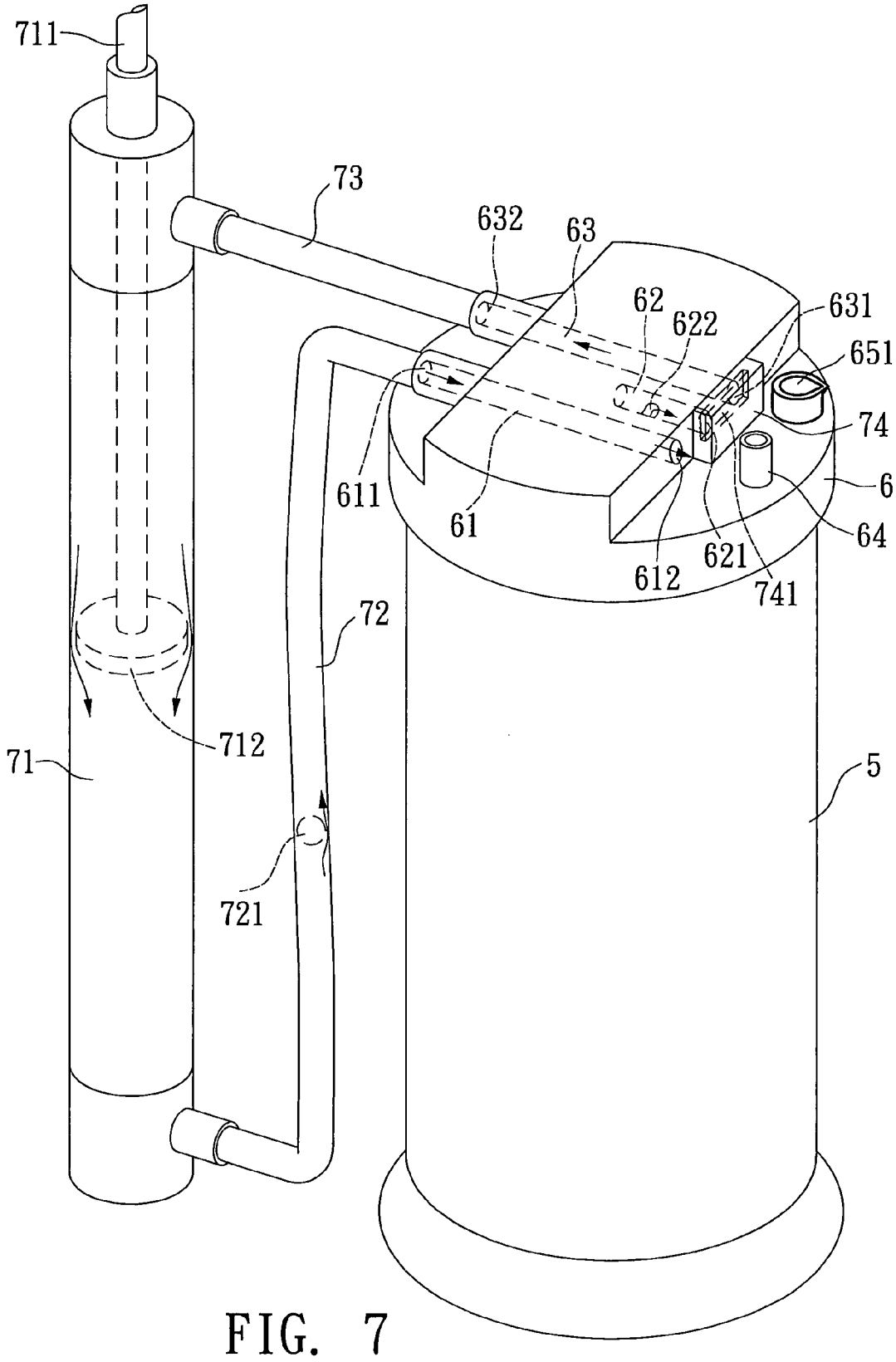
FIG. 7 is a perspective view showing a second preferred embodiment of the present invention with a regulating member being located at where allowing oil suction operation.
Figure 8:
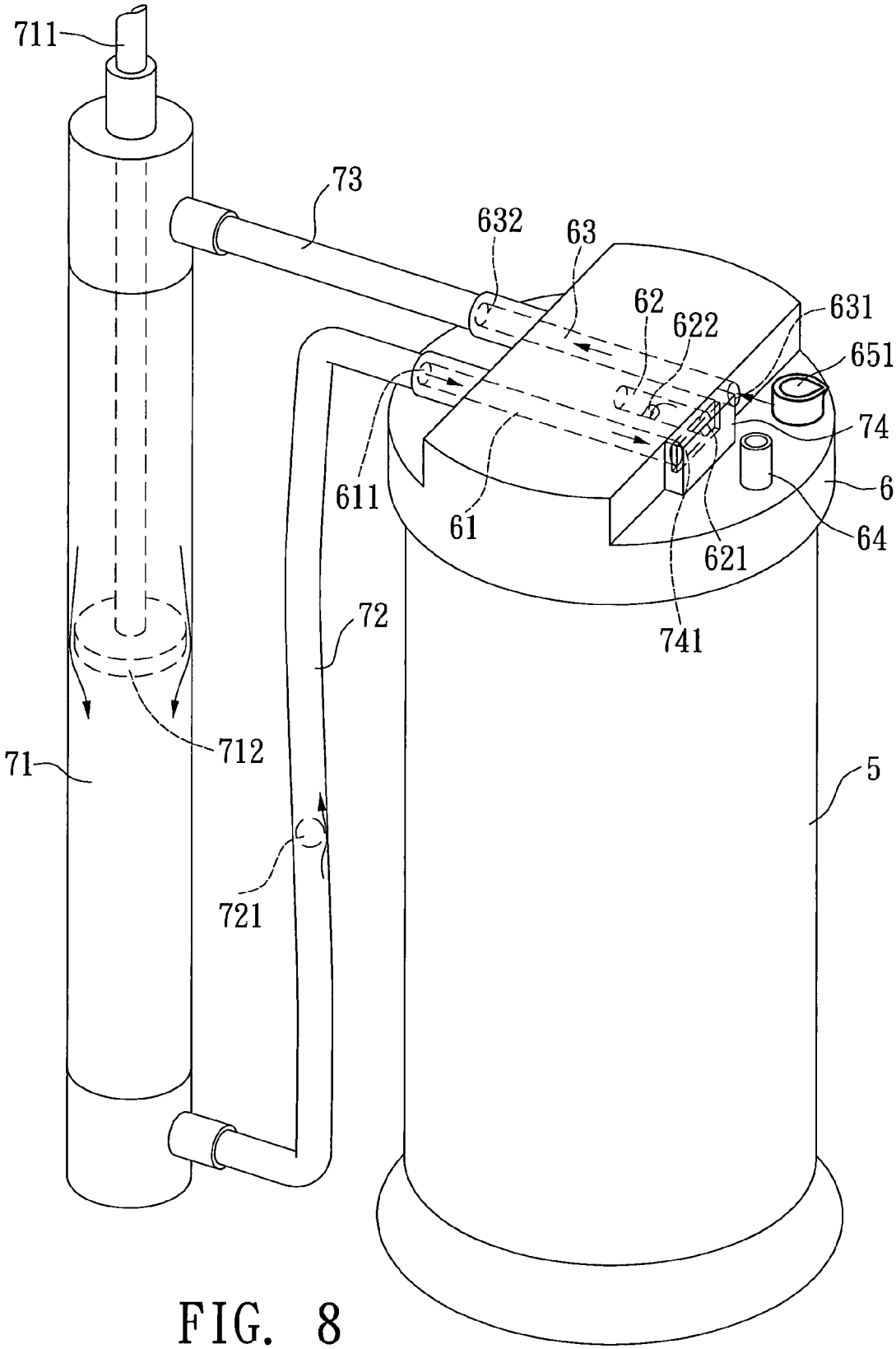
FIG. 8 is a perspective view showing the second preferred embodiment of the present invention with the regulating member being located at where allowing oil drain operation.
Figure 9:
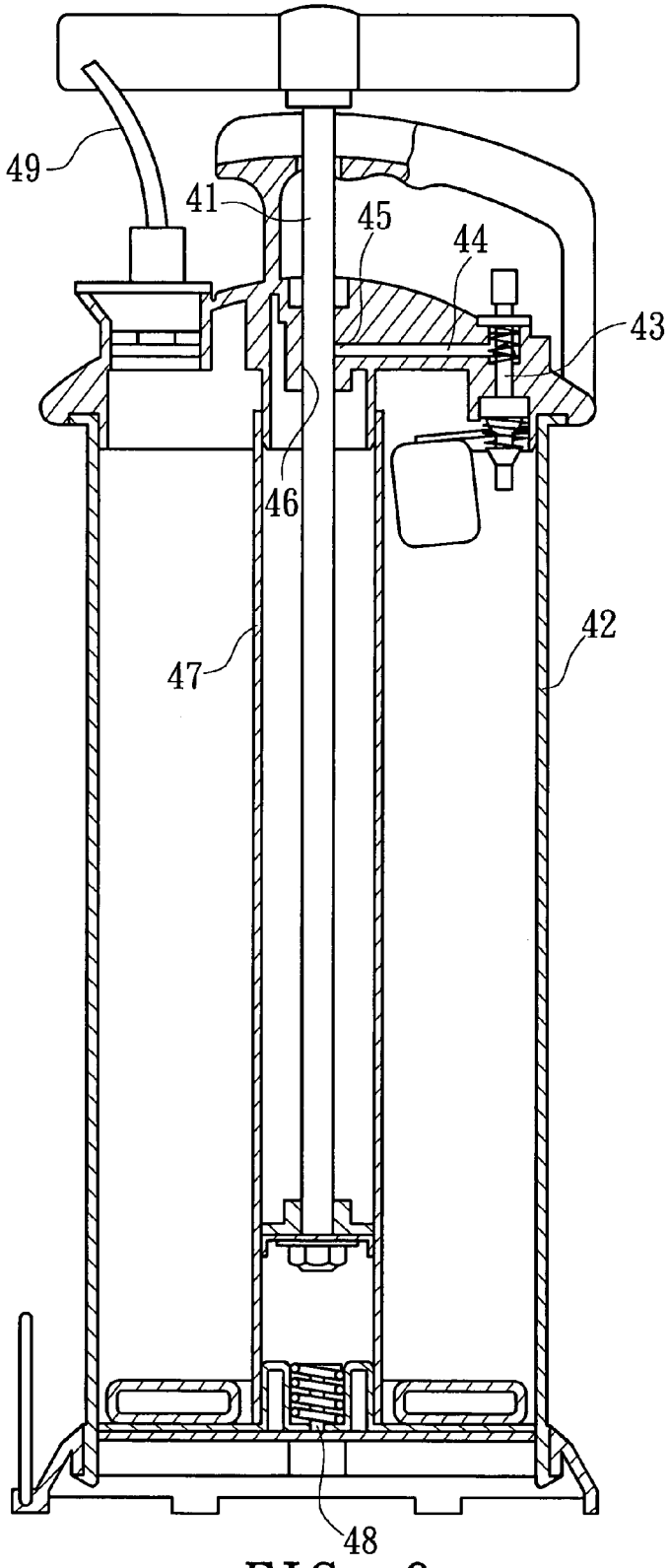
FIG. 9 PRIOR ART
FIG. 9 is a sectional view of a pump of the prior art that provides only the oil suction function.

Now referring to a second preferred embodiment of the present invention as illustrated in FIGS. 7 and 8, the pipe 13 and the ventilation pipe 14 otherwise installed inside the barrel in the first preferred embodiment are externally mounted to the barrel while a working principle for the first preferred embodiment by allowing air circulation among the first, the second, the third, and the fourth passages 12, 21, 22, and 23 after the switch is applied the same in the second preferred embodiment by respectively substitutions with members of a first airway, a second airway, a third airway, and an air duct. The second preferred embodiment is comprised of a barrel 5, a lid 6, a first airway 61, a second airway 62, a third airway 63, an air duct 73 and a regulating member 74. The barrel 5 contains an oil storage space (not illustrated). The lid 6 is disposed to close upon a top of the barrel 5. A pipe 71 and a ventilation pipe 72 are externally disposed to the barrel 5. The pipe 71 contains a pull rod 711. One end of the pull rod 711 in the pipe 71 is connected to a compression portion (piston) 712 to compress the air flowing through the pipe 71; and another end of the pull rod 711 extends upward to expose out of the pipe 71 and connected to a handle (not illustrated) to facilitate operating the pull rod 711. A lower end of the ventilation pipe 72 extends to connect the pipe 71 at where close to a lower end of the pipe 71 and is further connected through the pipe 71. An upper end of the ventilation pipe 72 extends to reach the lid 6.

The first airway 61 is located on the lid 6 and extends to penetrate through the lid 6. A first air inlet 611 and a first air outlet 612 are disposed to the first airway 61 with the first air inlet 611 connecting through the upper end of the ventilation pipe 72 and the first air outlet 612 being located on one side of the lid 6.

The second airway 62 is located on the lid 6 and is provided with a first through hole 621 and a second through hole 622 with the first through hole 621 located on one side of the lid 6 and the second through hole 622 being connected through the oil storage space.

The third airway 63 is located on the lid 6 and extends to penetrate through the lid 6. A second air inlet 631 and a second air outlet 632 are disposed to the third airway 63 with the second air inlet 631 located on one side of the lid. The second air inlet 631, the first through hole 621 are arranged side by side to the first air outlet 612.

The air duct 73 has one end connected to and through the second air outlet 632 of the third airway 63 and another end connected to where close to the upper end of the pipe 71 and connected through the pipe 71. The third airway 63, the air duct 73, the pipe 71, the ventilation pipe 72, and the first airway 61 are connected through in sequence to admit air circulation.

The regulating member 74 is disposed on the lid 6 to execute alternative switch in relation to the first air outlet 612 of the first airway 61, the first through hole 621 of the second airway 62, and the second air inlet 631 of the third airway 63. In oil suction operation, the regulating member 74 is dialed to permit the first through hole 621 of the second airway 62 to connect through the second air inlet 631 of the third airway 63 while connecting the first air outlet 612 of the first airway 61 through the ambient air. The pull rod is operated to cause the air in the oil storage space to circulate in sequent before finally being expelled to the ambient air through the first air outlet 612 of the first airway 61; accordingly, suction is produced inside the oil storage space to suck oil. In the oil drain operation, the regulating member 74 is dialed for the first air outlet 612 of the first airway 61 to connect through the first through hole 621 of the second airway 62 while admitting the ambient air to connect through the second air inlet 631 of the third airway 63. The pull rod is operated to cause the air to circulate in sequence before finally entering into the oil storage space through the second through hole 622 of the second airway 62 for producing pressure to drain the oil.

An air duct 741 is disposed to the regulating member 74 so that during oil suction operation, the first through hole 621 of the second airway 62 is connected through the second air inlet 631 of the third airway 63 via the air duct 741; or in oil drain operation, the first air outlet 612 of the first airway 61 connects through the first through hole 621 of the second airway 62 via the air duct 741; a leak-proof structure is disposed to openings respectively of the first air outlet 612 of the first airway 61, the first through hole 621 of the second airway 62, and the second air inlet 631 of the third airway 63. The leak-proof structure is assembled with the regulating member 74 so to prevent air current to escape from where between the leak-proof structure and the regulating member 74 while the regulating member 74 is executing alternative switch for regulation. A one-way valve 721 to restrict the air in the pipe 71 flows only towards the first airway 61; and an oil pipe to permit oil to flow and an oil pouring orifice 65 are provided to and penetrate through the lid 6.

The operation of oil suction and drain executed by the second preferred embodiment is generally same as that by the first preferred embodiment. The pull rod 711 is operated to drive the compression portion 712 for it to engage in reciprocal compression in the pipe 71 as a piston does, thus to divert the air to circulate depending on whether oil suction or oil drain operation id desired and according to the diversion direction designed to produce suction for oil suction or to procedure pressure for oil drain. Refer to the description given to the first preferred embodiment for a better understanding of the working principles of the operation and air circulation of the second preferred embodiment.

The present invention provides a pump that is capable of executing oil suction and oil drain operation by manual operation of a regulating member and a pull rod to easily complete work requirements of oil suction and oil drain without the necessity to prepare two pumps respectively for oil suction and oil drain as found with the prior art. The present invention helps save purchase costs and saves storage space available for other uses.

The present invention provides a structure of a pump for oil suction and oil drain in one unit, and the application for a patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. An oil suction and oil drain pump comprising:

a barrel including an oil storage space, a first passage being disposed on a bottom of the barrel, and the first passage being provided with a leading in hole and a leading out hole;

a lid coupled to a top portion of the barrel to define an enclosure, wherein said lid is formed with a second passage, a third passage, and a fourth passage extending laterally inside said lid between a top and a bottom surfaces thereof, a pipe being disposed within the enclosure, a lower end of the pipe being disposed on a bottom portion of the barrel and connecting through the leading in hole of the first passage, an upper end of the pipe being connected to the lid, a pull rod being disposed within the pipe, one end of the pull rod in the pipe being connected to a compression portion to compress air flowing through the pipe, the pull rod penetrating through and extending out of the lid, the second passage containing a first air inlet and a first air outlet, the first air inlet terminating at a side wall extending between said top and bottom surfaces of said lid, wherein said first air outlet connects to the pipe via an opening on a top portion of the pipe, the third passage being provided with a first through hole and a second through hole, said first through hole terminating at said side wall of said lid, wherein the second through hole connects to the oil storage space, the fourth passage being provided with a second air inlet and a second air outlet, the second air outlet of said fourth passage terminating at said side wall of said lid, wherein the second air inlet is formed in said lid in vertical alignment with said leading out hole formed in said bottom of the barrel, and wherein a ventilation pipe is attached at one end thereof to said second air inlet of said fourth passage and at another end thereof to said leading out hole, thereby connecting said second air inlet to the leading out hole of the first passage via said ventilation pipe disposed within the oil storage space to allow air to flow in sequence through the second passage, the pipe, the first passage, and the ventilation pipe to the fourth passage; and a laterally displaceable regulating member disposed at said side wall of the lid, said regulating member being formed with an air duct, wherein during an oil suction operation, said regulating member is laterally displaced along said side wall of the lid into alignment position with said first air inlet of said second passage and said first through hole of said third passage to establish air communication therebetween through said air duct, thereby connecting the third passage to the second passage and connecting the fourth passage to the ambient air to allow air in the oil storage space to be drained from the second air outlet of the fourth passage for producing the suction action; and wherein during an oil drain operation, said regulating member is laterally displaced along said side wall of the lid into alignment position with said first through hole of said third passage and said second air outlet of said fourth passage to establish air communications therebetween through said air duct, thereby connecting the fourth passage to the third passage and connecting the first air inlet of the second passage to ambient air for the air to enter through the second through hole of the third passage into the oil storage space for producing pressure to drain the oil.

2. The pump as claimed in claim 1, wherein the first passage is laterally disposed on the bottom of the barrel;

the first air outlet of the second passage connects to the pipe via a first perforation disposed on the lid; a second through hole of the third passage connects to the oil storage space via a second perforation disposed on the lid; and the fourth passage connects to the ventilation pipe via a third perforation disposed on the lid.

3. The pump as claimed in claim 1, wherein a leak-proof structure is disposed at openings respectively of the first air inlet of the second passage, the first through hole of the third passage, and the second air outlet of the fourth passage;

the leak-proof structure being assembled with the regulating member to prevent airflow to escape from between the leak-proof structure and the regulating member when the regulating member is executing alternative switch for regulating.

4. The pump as claimed in claim 1, wherein a one-way valve is provided in the ventilation pipe that connects to the first passage and the fourth passage to restrict a direction of air flow from the first passage towards the fourth passage.

5. The pump as claimed in claim 1, wherein an oil pipe for the oil to flow through is disposed at and penetrates through the lid.

6. The pump as claimed in claim 1, wherein a lever is disposed on the top surface of the lid in operative communication with said regulating member to facilitate operation of the regulating member.

7. The pump as claimed in claim 1, wherein an oil pouring orifice is further disposed on the lid.

* * * * *